United States Patent [19]

Koula

[11] 3,945,433

[45] Mar. 23, 1976

[54] VACUUM VAPORIZATION APPARATUS FOR HEATING ONE OR A NUMBER OF SEPARATE LIQUIDS

[75] Inventor: Zdenek Koula, Regensdorf, Switzerland

[73] Assignee: Stotz & Co., Zurich, Switzerland

[22] Filed: Oct. 2, 1972

[21] Appl. No.: 294,009

[30] Foreign Application Priority Data

Oct. 6, 1971 Germany ..... 2149884
Oct. 6, 1971 Germany ..... 2149885

[52] U.S. Cl. ..... 165/39; 165/105; 165/76; 126/377; 122/33; 237/19

[51] Int. Cl.[2] ..... A47J 27/16; F24D 3/08

[58] Field of Search ..... 165/105, 39, 76, 12; 126/377, 378, 374; 122/33; 237/19

[56] References Cited

UNITED STATES PATENTS

| | | | |
|---|---|---|---|
| 1,692,682 | 11/1928 | Montreuil | 126/377 |
| 1,959,377 | 5/1934 | Lucke | 126/377 |
| 2,083,611 | 6/1937 | Marshall | 165/105 X |
| 2,119,091 | 5/1938 | Atkinson et al. | 165/105 X |
| 3,112,877 | 12/1963 | Snelling | 165/105 X |
| 3,112,890 | 12/1963 | Snelling | 165/105 X |
| 3,155,155 | 11/1964 | Wallstrom et al. | 165/12 |
| 3,237,608 | 3/1966 | Brandl | 237/19 X |
| 3,472,314 | 10/1969 | Balch | 165/105 X |
| 3,609,206 | 9/1971 | McConnell | 165/105 X |
| 3,661,325 | 5/1972 | Schmidt | 237/19 X |

FOREIGN PATENTS OR APPLICATIONS

| | | | |
|---|---|---|---|
| 553,440 | 12/1956 | Belgium | 126/378 |
| 1,276,883 | 9/1968 | Germany | 122/33 |

*Primary Examiner*—Albert W. Davis, Jr.
*Attorney, Agent, or Firm*—Werner W. Kleeman

[57] ABSTRACT

An apparatus working according to the vacuum vaporization principle for heating one or a number of fluid mediums which are separated from one another wherein a separate heat exchanger for each fluid medium to be heated is arranged in an evacuated vessel partially filled with a vaporizable heating liquid medium. All of the heat exchangers are practically exclusively heated by the vapor of the vaporizable heating liquid medium. One or a number of components of the evacuated vessel which at least embody a respective heat exchanger are constructionally separated from the remaining component thereof constituting a heating component and connected therewith only by one or a number of connection conduits. The connection conduit or conduits are constructed and/or arranged such that recycling of the condensate of the heating liquid medium from the heat exchanger components or components to the heating component can occur without hindering the function of the apparatus.

8 Claims, 7 Drawing Figures

VACUUM VAPORIZATION APPARATUS FOR HEATING ONE OR A NUMBER OF SEPARATE LIQUIDS

BACKGROUND OF THE INVENTION

The present invention relates to a new and improved construction of apparatus, working according to the vacuum vaporization principle, for heating one or a number of liquids separated from one another, wherein a separate heat exchanger for each liquid to be heated is arranged at an evacuated vessel or container partially filled with a vaporizable heating fluid medium, and further wherein all heat exchangers are practically solely heated by the vapor of the vaporizable heating fluid medium.

Such type equipment is already known to the art, as exemplified for instance by German patent No. 1,270,258. It is used in particular as a hot water heater wherein, as a general rule, there are provided two heat exchangers, one of which serves to heat the water of a circulation heating installation, the other of which is designed as a boiler, and serves for heating-up the water which is to be consumed. The heating fluid medium can be also, for instance, water. Such type hot water heating equipment possess decisive advantages in contrast to hot water heaters of different construction.

Such was previously associated with the drawback of certain limitations in their construction and combination possibilities. Above all, larger size units were cumbersome to transport and required relatively large wall openings for installation purposes.

SUMMARY OF THE INVENTION

Hence, it is a primary object of the present invention to overcome the aforementioned drawbacks and limitations of the prior art proposals.

Another and more specific object of the present invention relates to a new and improved construction of vacuum vaporization apparatus for heating one or a number of liquids which are separated from one another, which apparatus is relatively simple in construction and design, economical to manufacture, extremely reliable in operation, easy to transport, and of relatively small constructional design.

Now in order to implement these and still further objects of the invention, which will become more readily apparent as the description proceeds, the inventive apparatus is manifested by the features that one or a number of components or parts of the evacuated vessel or container (heat exchanger component) encompassing at least one heat exchanger are constructionally separated from the remaining component or part thereof (heating component) and connected therewith only by one or a number of advantageously separable or disconnectible connection conduits. The connection conduit or conduits are designed and/or arranged in such a manner that the return flow or recycling of the condensate of the heating fluid medium from the heat exchanger component or components to the heating component can occur without hindering the function of the apparatus.

In this way, it is possible to fabricate and transport separately the individual components of the apparatus. The wall openings required for the installation of the equipment in a building can be maintained correspondingly smaller, and during repair it is not necessary to dismantle the entire equipment, rather the components thereof can be individually exchanged.

The inventive arrangement also renders possible spatially separately arranging the heat exchanger component from the heating component of the evacuated vessel with the combustion compartment. Thus, for instance, it is possible to arrange the heat exchanger component adjacent or below, instead of above, the heating component, so that there is realized an extremely small constructional height of the equipment. The recycling or return flow of the condensate of the heating fluid medium occurs in this case, of course, no longer simply under the action of the force of gravity, rather there must be provided for such purpose a condensate pump.

Finally, owing to the aforementioned constructional manifestations of the invention, it is also possible to associate a single heating component and therefore a single combustion compartment with a number of heat exchanger components which are connected with the heating component of the evacuated vessel or container by one or a respective connection conduit which can be closed by a valve. It has been found that the heating component with the combustion compartment generally can be maintained considerably smaller than the heat exchanger component. Accordingly, it is possible, with dimensions of the heating component which are generally of the same order of magnitude, to heat a number of heat exchanger components by means of a single combustion compartment. If the connection conduits are equipped with shut-off elements, as such will be more fully described hereinafter, then in such case the individual heat exchangers can be operated at different temperatures.

However, if desired, it is also possible to associate a number of heating components with a corresponding number of combustion compartments with a single heat exchanger component.

Advantageously, the connection conduit or conduits are provided with shut-off elements so that the heat exchanger component can be separated or disconnected from the heating component.

In this way, it is possible in a very simple manner to overcome a further drawback of the known installations working in accordance with the vacuum vaporization principle. In order to overcome disturbances, the temperature of the boiling water at the hot water heater should not exceed the limit where there begins to occur separation of minerals to a considerable extent, especially the formation of lime or calcium deposits. Otherwise, the latter will cause the conventional disturbances in the connected conduit system, especially clogging of the conduits and the valves of the mixing valve arrangements or batteries. Previously, during longer interruption in the withdrawal of the boiler water during the heating period, there could not be avoided an increase in the temperature of the boiler water beyond the critical limits for separation of the minerals, possibly up to a temperature of the heated vapor, for instance 95°C. Additionally, it was not possible to previously directly regulate the temperature of the boiler water during the heating period, rather only indirectly, that is to say, through the admixture of cold water.

Yet, if the connection conduit or conduits are equipped with shut-off elements, and if thereby the heat exchanger component is rendered disconnectible from the heater component, then in this manner it is possible to vary within relatively wide limits the temperature of the fluid medium or liquid heated by the relevant heat exchanger independently of the temperature of the heating agent vapor and the through-flow quantity. During use of the inventive apparatus as a hot water preparatory device or heater, the shut-off element is advantageously automatically controlled by means of a temperature feeler arranged in or at the disconnectible or separatable heat exchanger or a conduit which is in flow communication therewith, and specifically in such a manner that the temperature of the boiler water never exceeds the critical limit for the separation of minerals, especially separation of lime or calcium deposits.

For other uses, thus for instance for the purpose where the fluid media or liquids which are to be heated are never continuously heated to the same temperature, rather to variable temperatures as a function of time, the shut-off element is advantageously program-controlled.

The condition that the connection conduit or connection conduits are designed and/or arranged in such a manner that return flow recycling of the condensate of the heating fluid medium from the heat exchanger components to the heating component can occur without hindering the function of the apparatus can be realized, for instance, in that the connection conduit, or in the case of a number of connection conduits, have at least one such conduit designed large enough that vapor and the recycled condensate can flow therethrough without mutual hindrance, or in the case of a number of connection conduits at least one of such serves for the conveying of the vapor and at least another for the conveying of the recycled condensate.

BRIEF DESCRIPTION OF THE DRAWINGS

The invention will be better understood and objects other than those set forth above, will become apparent when consideration is given to the following detailed description thereof. Such description makes reference to the annexed drawings wherein generally the same reference numerals have been used throughout for the same or analogous components, and wherein.

DETAILED DESCRIPTION OF THE PREFERRED EMBODIMENTS

Figure 1:
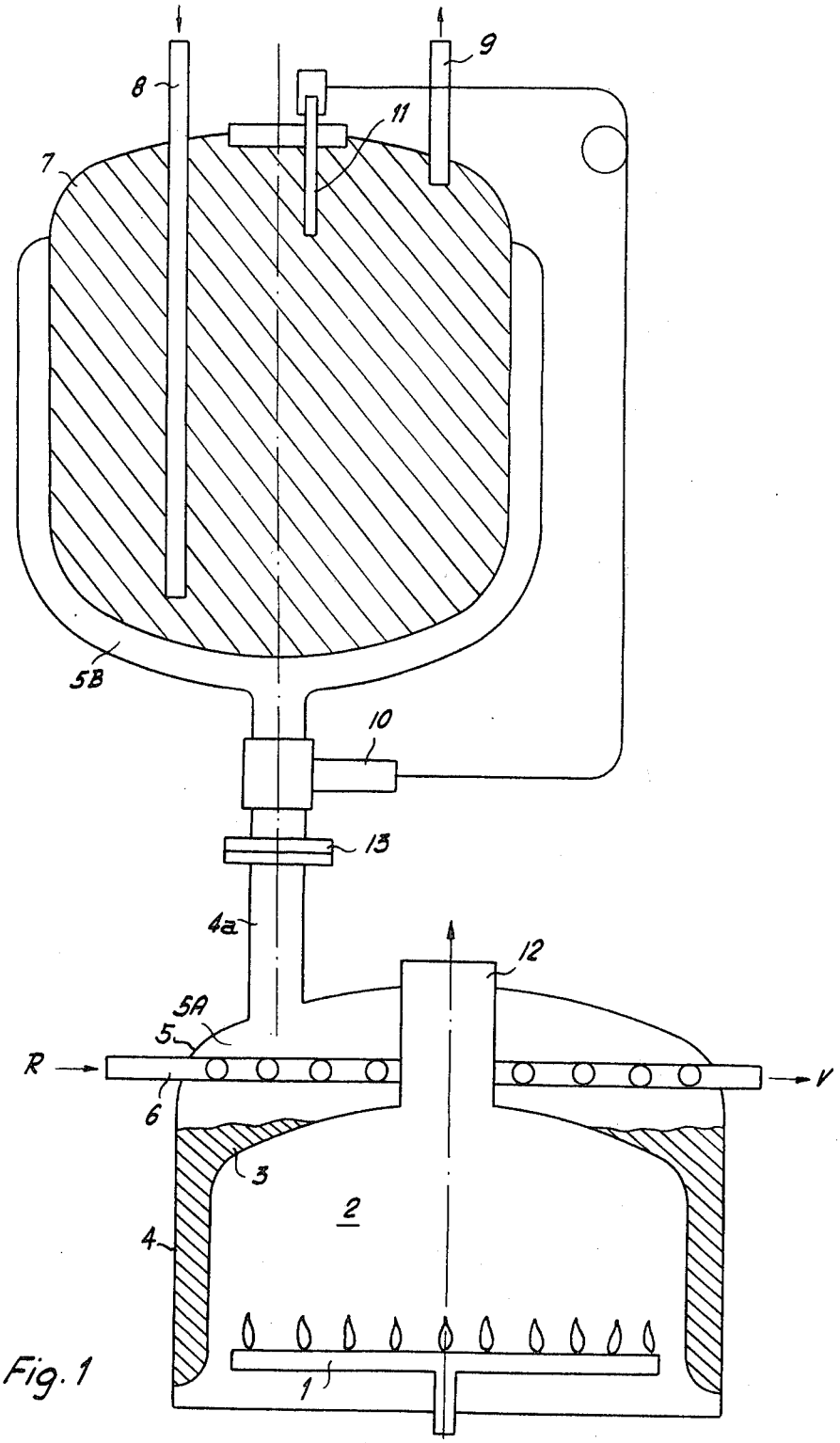
FIG. 1 schematically illustrates a first exemplary embodiment of inventive apparatus with a single heat exchanger component arranged above the heating component.

Describing now the drawings, the exemplary embodiment of hot water heater depicted in FIG. 1 will be understood to comprise a combustion compartment 2 heated by a suitable heat source 1, for instance gas. Such is formed by the lowermost portion of an evacuated vessel or container 4 filled with a fluid medium, here water 3, the vapor compartment 5 of which is separated into two components or parts by the connection conduit 4*a*, namely the heating component or part 5A and the heat exchanger or boiler component 5B. A circulation heating installation or a heat exchanger 6 is arranged in the heating component 5A to which there is infed the return flow R and from which there is removed the outflow or forward flow V. A boiler 7 is provided at the boiler component 5B, and fresh water is delivered thereto by means of conduit 8 and hot water removed therefrom by means of conduit 9.

The connection conduit 4*a* can be if desired, and as illustrated, shut-off by means of a suitable shut-off element 10, e.g. valve, which is actuated by a temperature feeler 11. The waste or flue gases escape from the combustion compartment 2 through the flue or outlet 12. The conduit or pipe 4*a* itself is provided with a flange connection 13 and therefore disconnectible.

Figure 2:
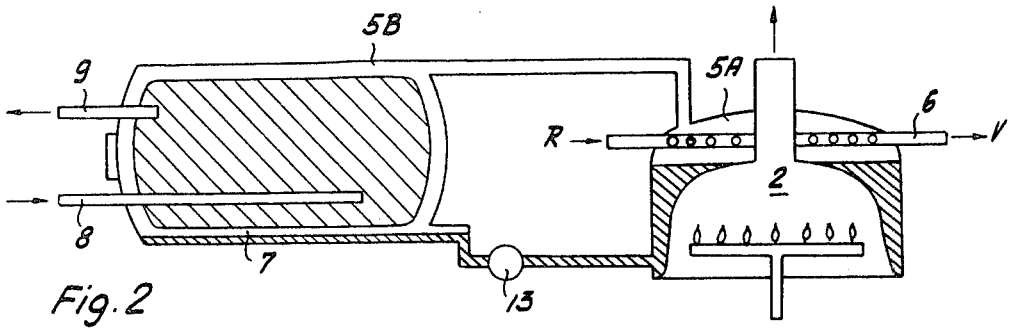
FIG. 2 illustrates a second exemplary embodiment of inventive apparatus wherein the heat exchanger component is arranged adjacent the heating component.

With the embodiment depicted in FIG. 2, the boiler component or heat exchanger component 5B together with the boiler 7 is arranged adjacent the heating component 5A with the combustion compartment 2. The return flow or recycling of the condensate of the heating liquid vapor from the boiler component 5B into the heating component 5A occurs by means of a pump 13.

Figure 3:
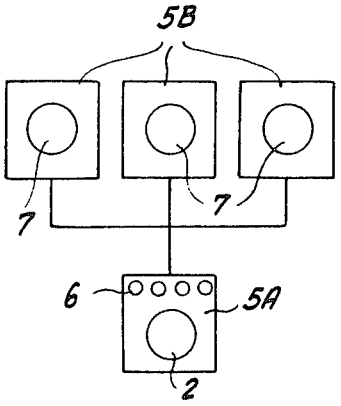
FIG. 3 is a schematic illustration of a further exemplary embodiment of the invention in which a single heating component is associated with a number of separate heat exchanger components.

With the embodiment schematically illustrated in FIG. 3, a single heating component 5A has associated therewith a number of separate boiler components 5B.

Figure 4:
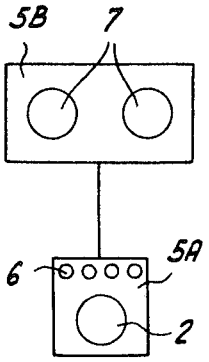
FIG. 4 is a schematic illustration of a further exemplary embodiment of the invention wherein a single heating component is associated with a single heat exchanger component embodying a number of boilers.

With the embodiment schematically depicted in FIG. 4, there is associated with a single heating component 5A a single boiler component 5B encompassing a number of boilers 7.

Figure 5:
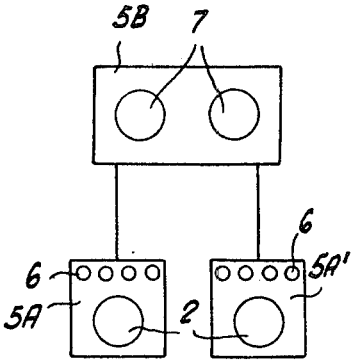
FIG. 5 is a schematic illustration of a further exemplary embodiment of the invention in which a single heat exchanger component embodying a number of boilers is associated with a number of heating components.

With the exemplary embodiment schematically depicted in FIG. 5, a number of heating components 5A and 5A' are associated with a single boiler component 5B encompassing a number of boilers 7.

Figure 6:
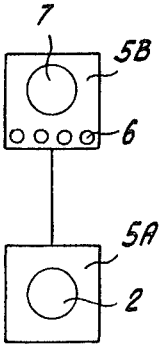
FIG. 6 is a schematic illustration of a still further exemplary embodiment of the invention in which all of the present heat exchangers are separated from the heating components.

With the exemplary embodiment of the invention schematically depicted in FIG. 6, the heat exchanger component or boiler component 5B encompasses all of the prevailing heat exchangers, namely both the heat exchanger 6 of a circulation heating installation as well as also the boiler 7, whereas in the heating component 5A there is not present any heat exchanger.

Figure 7:
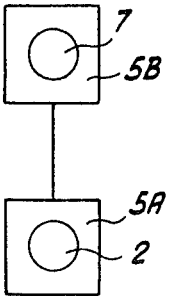
FIG. 7 is a schematic illustration of another exemplary embodiment of the invention in which there is provided only a single heat exchanger accommodated at the heat exchanger component.

Finally, in FIG. 7 there is schematically illustrated an exemplary embodiment of the invention serving for heating-up a single liquid or fluid medium. Accordingly, this embodiment possesses a single heat exchanger 7 which is arranged at the heat exchanger component 5B.

While there is shown and described present preferred embodiments of the invention, it is to be distinctly understood that the invention is not limited thereto, but may be otherwise variously embodied and practiced within the scope of the following claims. Accordingly,

What is claimed is:

1. A fluid heater apparatus working according to the vacuum vaporization principle and serving for heating one or a number of fluid mediums which are separated from one another, comprising an evacuated vessel at least partially filled with a vaporizable heating liquid medium, said evacuated vessel including at least two components constructionally separated from each other, a heat exchanger arranged at the evacuated vessel for each fluid medium to be heated, each heat exchanger being practically exclusively heated by the vapor or the vaporizable heating liquid medium, at least one heat exchanger defining one of said at least two constructionally separate components of said evacuated vessel, said at least one heat exchanger comprising a hot water heater, another component of said at least two components of said evacuated vessel defining a heating component, and means for removably connecting said at least two components of the evacuated vessel, said connecting means comprising a connection conduit having a cross-section substantially smaller than the cross-section of either of said two components, said connection conduit flow connecting separate components of said evacuated vessel, said connection conduit further being constructed and arranged to transmit the vapor of the vaporizable heating liquid medium in countercurrent flow with the condensate of the vaporizable heating liquid medium in such a manner that the return flow of the condensate from said at least one heat exchanger component to said heating component can occur without hindering the operation of the apparatus whereby said evacuated vessel is capable of being divided into said at least two constructionally separate components for ease of transportation to and assembly at an installation site.

2. The apparatus as defined in claim 1 including a plurality of heat exchanger components of the evacuated vessel constructionally separated from said heating component thereof and further including means for removably connecting each of said plurality of heat exchanger components with said heating components, said connecting means comprising connection conduits each having a cross-section substantially smaller than the cross-section of any of the components of the evacuated vessel said connection conduits flow connecting the heat exchange components with said heating components, said connection conduits further being constructed and arranged to transmit the vapor of the vaporizable heating liquid medium in countercurrent flow with the condensate of the vaporizable heating liquid medium.

3. The apparatus as defined in claim 1, further including a shut-off element for shutting-off the connection conduit.

4. The apparatus as defined in claim 3, further including a temperature feeler means for controlling the shut-off element.

5. The apparatus as defined in claim wherein the temperature feeler means is arranged at said at least one heat exchanger.

6. The apparatus as defined in claim wherein the temperature feeler means is arranged at a conduit communicating with said at least one heat exchanger.

7. The apparatus as defined in claim 3, wherein said shut-off element comprises a program-controlled shut-off means.

8. The apparatus as defined in claim 1, wherein said at least one heat exchanger component is arranged above said heating component, said connection conduit constituting the sole connection conduit for flow connecting said at least one heat exchanger component with the heating component.

* * * * *